United States Patent [19]

Chimura et al.

[11] 3,940,543

[45] Feb. 24, 1976

[54] UNITARY SPUN COMPOSITE FILAMENT

[75] Inventors: Kazuya Chimura; Takashi Kaneko; Shunichi Takashima; Masao Kawashima; Ryuichi Nakazono, all of Otake, Japan

[73] Assignee: Mitsubishi Rayon Co., Ltd., Tokyo, Japan

[22] Filed: Aug. 14, 1973

[21] Appl. No.: 388,164

[30] Foreign Application Priority Data

Aug. 14, 1972 Japan ..... 47-81306

[52] U.S. Cl. ..... 428/373; 264/DIG. 26

[51] Int. Cl.[2] ..... D02G 3/04

[58] Field of Search ..... 161/172, 175, 177; 264/DIG. 26; 428/373, 374

[56] References Cited

UNITED STATES PATENTS

| | | | |
|---|---|---|---|
| 3,589,956 | 6/1971 | Kranz et al. | 161/172 |
| 3,616,183 | 10/1971 | Brayford et al. | 161/175 |

OTHER PUBLICATIONS

Coleman, Journal of Polymer Science, 14, 15–28 (1954).

*Primary Examiner*—J. C. Cannon
*Attorney, Agent, or Firm*—Armstrong, Nikaido & Wegner

[57] ABSTRACT

A novel unitary spun polyester composite filament is provided. The composite filament consists essentially of (*a*) a block copolymer, as the first component, having a melting point of not lower than 170°C and consisting essentially of 35–80 wt. % of a polyester, as the hard segment, predominantly containing a tetramethylene terephthalate unit and 20–65 wt. % of a long-chain glycol having a molecular weight of 500 to 5,000 as the soft segment, and (*b*) a polyester, as the second component, predominantly containing a tetramethylene terephthalate unit. The composite filament produces crimps superior particularly in percent of crimp and percent of crimp retentivity when drawn and relaxed.

10 Claims, No Drawings

UNITARY SPUN COMPOSITE FILAMENT

This invention relates to a unitary spun polyester composite filament excellent in crimp characteristics and dyeing properties. More particularly, it relates to a unitary spun composite filament containing polytetramethylene terephthalate as one component, which have an enhanced soft feel and are superior in elastic properties and dyeing properties, as compared to conventional crimped polyester filaments. It further relates to a process for producing such a unitary spun composite filament.

Crimped filaments consisting of two or more polymer components different in shrinkage and eccentrically disposed in the cross-section are known in the art. Even in the limited field of polyester composite filaments, various combinations of polymer components and various processes for their production have been hitherto proposed. However, these composite polyester filaments do not have satisfactory crimp characteristics. That is, they have a poor crimp-developing force, and the crimps are poor in fastness.

In order to improve crimp characteristics, it has been proposed to employ an elastomer such as polyurethane and N-substituted polyamide as one component of a composite filament as disclosed in Japanese Patent No. 9852/1972, British Pat. No. 1,095,147 and Belgian Pat. No. 741,367. The other component of such a composite filament is a polyamide filament. It is difficult, however, to employ an elastomer as one component of a polyester composite filament for the following reasons. First, an elastomer such as polyurethane and N-substituted polyamide is poor in adhesion to a polyester component. Secondly, since such elastomer components tends to stick to each other at an elevated temperature, both melt-spinning and drawing of the composite filaments cannot be performed without trouble. Particularly, the polyurethane elastomer is inferior in thermal stability, and is usually subject to intense degradation in a molten state at temperatures exceeding 220°C.

It is an object of the present invention to provide a unitary spun polyester filament having greatly improved crimp characteristics and elastic recovery as compared to known polyester composite filaments.

It is another object of the present invention to provide a unitary spun polyester composite filament which has a soft feel and which is superior in dyeing properties and abrasion resistance to known polyester composite filaments.

Other objects and advantages of the present invention will be apparent from the following description.

In accordance with the present invention, there is provided a unitary spun composite filament consisting essentially of (*a*) a block copolymer, as the first component, having a melting point of not lower than 170°C and consisting essentially of 35 to 80% by weight of a polyester containing not less than 80% by mole of a tetramethylene terephthalate unit as the hard segment and 20 to 65% by weight of a long-chain glycol having a molecular weight of 500 to 5,000 as the soft segment, and (*b*) a polyester, as the second component, containing not less than 80% by mole of a tetramethylene terephthalate unit.

One feature of the invention is the employment of the block copolymer of (*a*) above as the first component of the composite filament. It has hitherto been difficult to spin block copolyesters into filaments by a melt spinning procedure without trouble because most block copolymesters have a poor thermal resistance and tend to stick to each other at the spinning temperature. The tendency of sticking to each other is a serious problem because this tendency prevents a stable spinning and wind-up operation and the withdrawal of filaments from the bobbin. In order to produce filaments therefrom without trouble, it is necessary to either employ a special process or apparatus, or accept a reduction in productivity.

It has now been found that a block copolyester, which contains 35 to 80% by weight, preferably 45 to 80% by weight, of a polyester block component predominantly composed of a tetramethylene terephthalate unit and has a melting point of not lower than 170°C, preferably not lower than 190°C, does not have such undesirable tendency. It is speculated that the above fact is due to the high crystallinity of the polytetramethylene terephthalate block component. This is substantiated by the fact that the more the proportion of the tetramethylene terephthalate unit in a copolyester increases, the more the crystallinity of the copolyester increases. The term "melting point" as used in this specification means that point expressed by a temperature at which the heat absorption reaches maximum when determined by using a DSC-1 type Differential Scanning Calorimeter (made by Perkin Elmer) at a temperature elevation rate of 10°C/min in an atmosphere of nitrogen.

When the block copolymer having a melting point of not lower than 170°C and containing 35 to 80% by weight of a polyester predominantly containing a tetramethylene terephthalate unit as the hard segment is employed as one component of a composite filament, all the process steps from spinning and wind-up to drawing and heat treatment can be smoothly performed. This advantage leads to an increase of the productivity and an improvement of the crimp characteristics and the dyeing properties.

As hereinbefore referred to, when a conventional block copolymer containing polyethylene terephthalate as the hard segment is employed as one component of a composite filament, it is difficult to withdraw undrawn filaments at a high speed from the bobbin because of their high stickiness. This leads to fluffing of the filaments and, sometimes, breakage of the filaments, and reduction of the spinning and wind-up speed.

When the block copolymer used as one component of the composite filament of the invention contains the polyester component predominantly containing a tetramethylene terephthalate unit, in a proportion of more than 80% by weight, the resulting crimped composite filament has poor crimp characteristics which are approximately equal to those of conventional composite filaments containing polyethylene terephthalate as one component, although the spinning and drawing can be performed without trouble. It is to be noted that the block copolymer used as one component of the composite filament of the invention is of little or no practical use when the copolymer is intended to be used as a raw material for a single component filament. That is, melt-spun, undrawn filaments of the copolymer are far inferior in elastic recovery to conventional elastomer filaments such as polyurethane filaments because the copolymer has a high crystallinity. For example, an elastic recovery of the filament is only 40 to 70% at an elongation exceeding 100%. This seems to be due to the fact that the single component filament, in an undrawn state, has a crystal structure such that the soft segment, which is conductive to the elastic properties, is enveloped in the hard, crystalline matrix. However, when the undrawn filament is drawn, the filament becomes good in elastic recovery, because a rubber-like microcrystalline structure is formed, i.e. the released soft segment behaves like rubber in a structure such that the crystalline portion consisting of the polytetramethylene terephthalate hard segment is a false cross-linked point.

Therefore, a drawn composite filament containing, as one component, the polymer predominantly containing a tetramethylene terephthalate unit exhibits improved crimp characteristics. When the drawn filament is subjected to heat treatment, the filament exhibits for improved elastic recovery and crimp retentivity.

The block copolymer, which is used as one component of the composite filament of the invention, should contain 20 to 65% by weight of a long-chain glycol having a molecular weight of 500 to 5,000 as the soft segment. When the long-chain glycol has a molecular weight of lower than 500, the resulting filament has a high stickiness and exhibits poor operational stability in the spinning and drawing steps. Further, since the block copolymer has a reduced elastic recovery, the resulting composite filament is inferior in crimp characteristics. In contrast, when the long-chain glycol has a molecular weight of higher than 5,000, it becomes difficult to obtain a block copolymer having a high molecular weight. This seems to be because the long-chain glycol of an excessively high molecular weight has reduced compatibility with the polytetramethylene terephthalate component. The long-chain glycol of an excessively high molecular weight results in a block copolymer having poor elastic and mechanical properties and hence, a composite filament having poor operational stability in the spinning and drawing steps and poor crimp characteristics.

As the long-chain glycol having a molecular weight of 500 to 5,000, polyalkyleneether glycols such as polyethylene-ether glycol, polypropyleneether glycol, polytetramethylene-ether glycol and a random or block copolymer of ethylene oxide and propylene oxide may be used. Also, polybutadiene glycol, polyisoprene glycol and their hydrogenated products may be used.

The block copolymer should have an intrinsic viscosity [$\eta$] of at least 1.3 in order to produce a crimped composite filament of the desired mechanical properties. By the intrinsic viscosity used herein is meant that determined as a solution in a 1 : 1 mixture of tetrachloroethane and phenol at a temperature of 25°C. The intrinsic viscosity of the block copolymer has a close relation to the melt viscosity, and influences the occurrence of undesirable kneeling at the time of melt extrusion and the uniformity in a bonded state of two components. Therefore, the intrinsic viscosity should be suitably chosen.

The hard segment of the block copolymer predominantly contains the tetramethylene terephthalate unit as hereinbefore referred to. However, the hard segment may contain a minor amount of up to 20% by mole of other components. For example, in order to give oxidation resistance and light resistance to the block copolymer, a phenol compound represented by the following formula (I) or a triazine compound represented by the following formula (II) may be incorporated as the minor component.

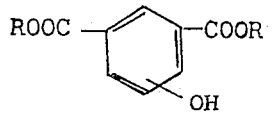

(I)

wherein R signifies a hydrogen atom, an alkyl group having 1 to 8 carbon atoms or a phenyl group and OH group is attached to O- or m-position to COOR group.)

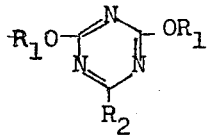

(II)

(wherein $R_1$ signifies an alkyl group having 1 to 7 carbon atoms or a phenyl group, and $R_2$ signifies an alkylamino or dialkylamino group, the alkyl moiety having 1 to 12 carbon atoms.) The phenol compound of the formula (I) includes, for example, 5-hydroxyisophthalic acid, 2-hydroxyisophthalic acid, 4-hydroxyisophthalic acid, dimethyl 5-hydroxyisophthalate, dimethyl 2-hydroxyisophthalate, dimethyl 4-hydroxyisophthalate, diethyl 5-hydroxyisophthalate, diethyl 2-hydroxyisophthalate, diethyl 4-hydroxyisophthalate, diphenyl 2-hydroxyisophthalate and diphenyl 4-hydroxyisophthalate. The triazine compound of the formula (II) includes, for example, 2,6-dimethoxy-4-dimethylamino-S-triazine, 2,6-dimethoxy-4-diethylamino-S-triazine, 2,6-dimethoxy-4-n-propylamino-S-triazine, 2,6-dimethoxy-4-n-butylamino-S-triazine, 2,6-dimethoxy-4-di-n-butylamino-S-triazine, 2,6-dimethoxy-4-n-laurylamino-S-triazine, 2,6-diphenoxy-4-diethylamino-S-triazine, 2,6-diphenoxy-4-n-propylamino-S-triazine, 2,6-diphenoxy-4-n-butylamino-S-triazine, 2,6-diphenoxy-4-n-butylamino-S-triazine and 2,6-diphenoxy-4-n-laurylamino-S-triazine.

If desired, when the block copolymer is prepared, a suitable amount, e.g. 0.01 to 7% by weight, of antioxidant or light-stabilizer may be incorporated such as sym.-di-$\beta$-naphthyl-p-phenylene diamine and other aromatic amine compounds; or a metal-containing compound represented by the following formula (III)

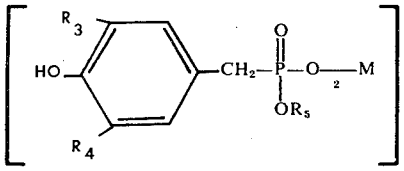

(III)

wherein $R_3$ and $R_4$ are the same or different and signify a hydrogen atom or a hydrocarbon radical having 1 to 10 carbon atoms; $R_5$ signifies a hydrocarbon radical having 1 to 10 carbon atoms and M signifies nickel or manganese. The metal-containing compound of the formula (III) includes, for example,

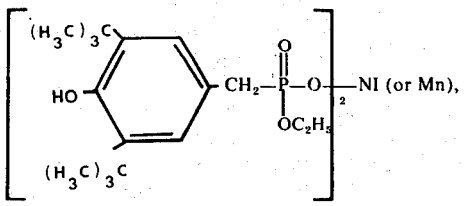

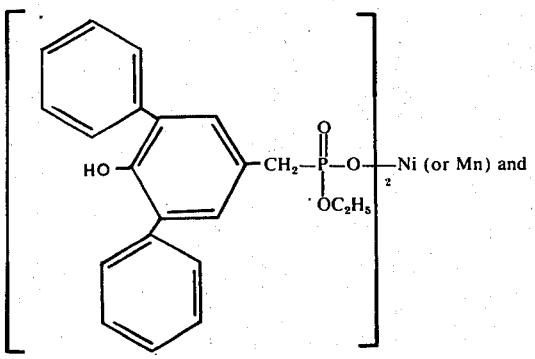

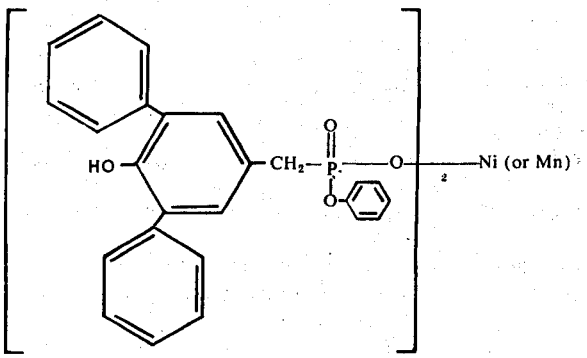

Another feature of the invention is the employment of a polyester containing not less than 80% by mole of a tetramethylene terephthalate unit, as the second component of the composite filament. this polyester component exhibits a good adhesion to the first component, i.e. the block copolymer component hereinbefore mentioned, because the block copolymer contains at least 35% by weight of a polyester predominantly containing a tetramethylene terephthalate unit. The polyester component predominantly containing a tetramethylene terephthalate unit, when melt-spun singly, results in undrawn filaments which are capable of being cold-drawn and exhibit good molecular orientation and crystallization. These characteristics of the polyester component contribute to enhancement of the crimp developing faculty of the resulting composite filament. Further, the undrawn filaments of the above polyester component are characterized as being superior in elastic recovery. This characteristic and the similar characteristic of the block copolymer component hereinbefore referred to are correlative to improve the crimp characteristics of the composite filament.

When a composite filament is produced from the above polyester component and the block copolymer component, the two components can be melt-spun at a temperature close to their melting points, usually at a temperature of 230° to 270°C. As a consequence, undrawn filaments are obtained without the deterioration of polymers and, therefore, uneven dyeing and crimping can be avoided or minimized. The polyester component should contain at least 80% by mole, preferably almost 100% by mole, of a tetramethylene terephthalate unit. However, the polyester component may contain a minor amount of other monomer unit unless the cristallinity and the filament characteristics are badly influenced.

The monomer used in a minor amount includes, for example, terephthalates of an alcohol such as ethylene glycol, trimethylene glycol, 1,4-cyclohexane dimethanol, glycerin and pentaerythritol; and isophthalates, 1,4- or 1,5-naphthalates, adipates or sebacates of an alcohol such as ethylene glycol, trimethylene glycol, tetramethylene glycol, 1,4-cyclohexane dimethanol, glycerin and pentaerythritol. Of these monomers, esters of tri- or tetrafunctional alcohols such as glycerin and pentaerythritol result in a composite filament having a more improved elastic recovery; and adipates and esters of 1,4-cyclohexane dimethanol result in polymers of a suitable melt viscosity which advantageously prevents occurrence of kneeling at melt-spinning. Further, the monomer includes dicarboxylates, such as terephthalates, isophthalates and 1,4- or 1,5-naphthalenedicarboxylates, of polyalkyleneether glycols such as polyethyleneether glycol, polypropyleneether glycol, polytetramethyleneether glycol and a copolymer of ethylene oxide with propylene oxide, and polybutadiene glycol, polyisoprene glycol and their hydrogenated products.

When the polyester component contains less than 80% by mole of a tetramethylene terephthalate unit, i.e. more than 20% by mole of the above monomers, the polyester possesses reduced crystallinity and melting point and the resulting composite filaments become poor in thermal resistance and dimensional stability.

The polyester component further should have an intrinsic viscosity $[\eta]$ of at least 0.6. An intrinsic viscosity $[\eta]$ of lower than 0.6 leads to the fluffing and breakage of filaments, and the reduction of the mechanical properties of filaments.

A process for producing the composite filaments will now be described.

The block copolymer composed of the hard segment and the soft segment may be prepared, for example, in a manner similar to that disclosed in the Journal of the Society of Fiber Science and Technology, Japan, Vol. 27, 153–161 (1971). For example, a mixture of stated amounts of dimethyl terephthalate, 1,4-butanediol and a long-chain glycol are heated at a temperature of 150° to 220°C in the presence of a titanium compound catalyst to effect ester-interchange. Then, the reaction mixture is heated at a temperature of 230° to 260°C under a reduced pressure of lower than 5 mmHg to effect polycondensation. The entire amount of the long-chain glycol used herein may be considerered as converted into the block copolymer. Therefore, the ratio by weight of the soft segment to the hard segment contained in the block copolymer may be easily calculated from the amount of the long-chain glycol used.

The two polymer components, i.e. the block copolymer of (*a*) and the polyester of (*b*) are separately molten and extruded through orifices and joined together at a temperature of 230° to 270°C. The block copolymer component generally degrades to a considerable extent at temperatures exceeding 270°C. Therefore, the upper limit of the spinning temperature is 270°C. The extrusion of the two components may be performed in side-by-side relationship or in an eccentrically disposed sheath-core arrangement. The proportion of the block copolymer of (*a*) to the polyester of (*b*) may be suitably varied, depending upon the particular block copolymer of (*a*) and the intended crimp characteristics, and usually falls within the range of 15/85 to 85/15 by weight. For optimum results, the ratio is generally approximately 50 : 50 by weight.

Undrawn filaments so obtained are not sticky, and therefore can be withdrawn at a high speed from the bobbin. It is said that side-by-side relationship is usually advantageous over an eccentrically disposed sheath-core arrangement in view of the crimp characteristics and the evenness of crimps. However, this only true if both components of the composite filaments exhibit no undesirable stickiness, because, if one component of the composite filaments in the side-by-side relationship is sticky, the filaments cannot be withdrawn at a high speed. Thus, side-by-side relationship is usually preferred in the production of the composite filament of the present invention because the filaments are not sticky.

However, when staple fibers suitable for an elastic spun yarn and fillings for bedding and cushions are desired, an eccentrically disposed sheath-core arrangement is adopted so as to control the level of crimps and impart a variety of properties. In this case, it is possible to provide a composite filament of desired properties.

The block copolymer component of (*a*) and the polyester component of (*b*) preferably have intrinsic viscosities of at least 1.3 and at least 0.6, respectively, in order to obtain the desired mechanical properties and crimp characteristics, as mentioned hereinbefore. However, in order to achieve a completely stable spinning operation, it is most preferable that the difference $([\eta]_1 - [\eta]_2)$ in intrinsic viscosity between the block copolymer component of (*a*) and the polyester component of (*b*) satisfy the following relation, $$-0.1 \leq [\eta]_1 - [\eta]_2 \leq 1.0$$

wherein $\eta_1$ is the intrinsic viscosity of the block copolymer component of (*a*) and $[\eta]_2$ is that of the polyester component of (*b*). When the difference $([\eta]_1 - [\eta]_2)$ does not satisfy the above relation, the composite filament tends to kneel and, sometimes, adhere to the surface of a spinning nozzle, leading to the breakage of the filament.

Undrawn filaments may be drawn at a speed nearly equal to that employed in the drawing of conventional polyester filaments. In order to far enhance the crimp developing faculty, it is preferable to draw the filaments at room temperature without employment of any heating means. The drawing may be performed either in a one step process or a two or more step process. The one step drawing process is usually performed by drawing the filament not less than 0.75 times the maximum draw ratio. For optimum results, the drawing is performed in two steps, for example, the filament is drawn, in the first step, 0.7 to 0.75 times its maximum draw ratio and then in the second step, 1.05 to 1.35 times its length as drawn in the first step. By the term "maximum draw ratio" is meant a maximum ratio at which the filament can be drawn without breakage at the drawing conditions employed. The maximum draw ratio varies depending upon the conditions under which undrawn filaments are produced, such as spinning temperature, spinning velocity and polymerization degree of the polymers employed, and the conditions under which the filaments are drawn, such as drawning temperature, drawing velocity and the type of drawing employed. It now has been found that, when the filaments are drawn by a two step process an optimum draw ratio in the first drawing step is 0.7 to 0.75 times the maximum draw ratio irrespective of the above spinning and drawing conditions. The undrawn filament may be drawn at an elevated temperature or subjected to heat treatment under tension by using a hot plate, for the purpose of controlling the dimensional stability of the crimped filament at an elevated temperature and the percentage crimp thereof.

Drawn filaments may be woven or knitted into fabric after they are wound up on a pirn or a cheese. Drawn filaments may be subjected to heat treatment under a relaxed condition prior to weaving or knitting, for the purpose of enhancing the crimp fastness and the bulkiness. From the point of view of productivity this heat treatment is preferably carried out successively after the drawing. It is most preferable to use an ejector to feed a bundle of drawn filaments in a relaxed state into a heated box where the filaments are subjected to heat-set under a relaxed condition. In order to realize the relaxed condition, the filaments are fed into the heated box at an over-feed rate of 15 to 70%, preferably 20 to 50%. The over-feed rate may be calculated from the following equation.

$$\text{Over-feed rate} = (V_f - V_D)/V_f$$

wherein $V_f$ is a feeding velocity of the filament and $V_D$ is a withdrawal velocity of the filament. Since the composite filaments of the invention are readily separated when the bundle is loosened, uniform and bulky crimped composite filaments can be stably produced at a high velocity.

The crimped composite filaments have a softer feel, and are superior in crimp retainability and dyeing properties, as compared to conventional polyester composite filaments. Particularly, the crimped composite filaments of the invention can be advantageously dyed at atmospheric pressure at a temperature of 100°C without employment of any carrier. This forms a marked contrast to the conventional crimped polyester filaments which cannot by dyed without employment of a special costly dyeing procedure such as high pressure dyeing and carrier dyeing.

The crimped composite filaments of the invention may be woven or knitted into fabric or cut into staple fibers. The staple fibers are useful as fillings for bedding and cushions because they are soft and bulky and excellent in crimp retentivity.

Further, the crimped composite filaments of the invention are superior in abrasion resistance. This would not be expected from the conventional polyester filaments. This advantage seems to be due to the structure of polytetramethylene terephthalate, and shows that the crimped composite filaments of the invention are useful in manufacturing as socks and stockings because they have a soft feel and a high percentage crimp, in addition to their abrasion resistance.

The following examples are given to illustrate the invention and are not to be considered as limiting in any sense.

In the Examples, the percentage crimp and percentage crimp retentivity are determined as follows.

Percentage crimp: The specimen filament is wound five times to prepare a skein. The length ($l$) of the skein is measured when a load of 2 mg/d is applied to the skein, and the length ($m$) is measured when a load of 200 mg/d is applied. The percentage crimp is calculated from the following equation:

$$\text{Percentage crimp} = m - l/m \times 100\ (\%)$$

Percentage crimp retentivity: An initial percentage crimp ($CP_o$) is determined as mentioned above. Then, a load of 200 mg/d is applied to the skein over a period of 24 hours and, thereafter a percenrage crimp ($CP_{24}$) is similarly determined. The percentage crimp retentivity is expressed by the following equation:

$$\text{Percentage crimp retentivity} = CP_{24}/CP_o \times 100\ (\%)$$

EXAMPLE 1

A mixture of 5.00 kg of dimethyl terephthalate, 3.70 kg of 1,4-butanediol and 5.00 kg of polytetramethyleneether glycol having a molecular weight of approximately 1,000 was heated, in the presence of 5 g of titanium tetrabutoxide, and maintained at a temperature of from 150° to 210°C for two hours to effect an ester interchange reaction. Then, the reaction product was heated to a temperature of 240°C under a gradually reduced pressure and finally maintained at the temperature under a reduced pressure of 1 mmHg for two hours to effect polycondensation.

The resultant block copolymer was composed of 53% by weight of polytetramethylene terephthalate component as a hard segment and 47% by weight of polytetramethyleneether glycol component as a soft segment, and had an intrinsic viscosity [$\eta$] of 1.78 and a melting point of 202°C.

This block copolymer and polytetramethylene terephthalate having an intrinsic viscosity [$\eta$] of 0.9 were spun by a melt spinning procedure at a ratio of 1 : 1 by weight and a temperature of 243°C into side-by-side composite filaments having a fineness of 163 denier/24 fils. The undrawn composite filaments could be smoothly withdrawn from the bobbin without adhesion between the filaments. The undrawn filaments were drawn 3.25 times their original length at room temperature by using a porcelain pin of a 10 mm diameter but not using any heating means, and wound on a pirns. The operation of drawing and winding could be smoothly performed without such trouble as fluffing of the filaments or undesirable winding of the filaments on a roller. When the drawn filaments were unwound from the pirn, very fine, helical crimps developed. The crimped filaments had a percentage crimp of 62% and a percentage crimp retentivity of 67%. This percentage crimp retentivity is higher than that of a crimped polyamide filament which is said to be superior in crimp retentivity to other conventional crimped filaments.

The crimped filaments, after being knitted into hosiery, were dyed at a temperature of 100°C at atmospheric pressure without employment of any carrier by using Resolin blue FBL (CI Generic name; CI Disperse Blue 56) at a concentration of 4% owf. The dyed hosiery exhibited no uneven dyeing and had a uniform texture and soft feel. The dye receptivity was approximately three times that observed when a commercially available polyethylene terephthalate textured filament was dyed.

Examples 2 – 7 and Comparative Examples 1 – 4

From the same polytetramethylene terephthalate as that used in Example 1 and various block copolymers denoted (A) through (H) in Table I below crimped side-by-side composite filaments were produced in the same manner as those of Example 1. Spinnability, drawability and crimp characteristics of the filaments are shown in Table I.

Table I

| | Block copolymer | | | Crimp characteristics | | |
|---|---|---|---|---|---|---|
| | Ratio of hard segment/soft segment (by weight | Intrinsic viscosity [η]and melting point (m.p.) | Spinnability and drawability | % Crimp | % Crimp retentivity | Remarks |
| Comparative Example 1 | PET 45/(A) 55 | [η] 1.65 m.p. 223 °C | Poor in drawability; increased adhesions between filaments on drawing | — | — | Difficult to obtain crimped filaments |
| Example 2 | PTMT 85/(A) 15 | [η] 1.55 m.p. 215°C | Poor in operational stability in drawing | 38 | 25 | Hosiery had poor elastic property and bulkiness |
| Example 3 | PTMT 30/(A) 70 | [η] 1.89 | Very sticky and poor in operational stability in drawing | 30 | 18 | Inferior in level dyeing property, tensile strength and uniformity of crimps |
| Example 4 | PTMT 50/(D) 50 | [η] 1.45 | " | 35 | 27 | Hosiery was thin and poor in elastic property |
| Example 2 | PTMT 52/(E) 48 | [η] 1.88 m.p. 205°C | not sticky and good drawability | 67 | 65 | Hosiery had good elastic property |
| Example 3 | PTMT 50/(F) 50 | [η] 1.63 m.p. 194°C | " | 60 | 63 | " |
| Example 4 | M-PTMT 52/ (G) 48 | [η] 1.68 m.p. 190°C | "57 | 60 | yellowish, but dyed | Composite filaments as spun were slightly hosiery was bright and good in elastic property |
| Example 5 | PTMT 50/(H) 50 | [η] 1.65 m.p. 195°C | " | 50 | 45 | Superior in both crimp characteristic and dyeing property |
| Example 6 | PTMT 60/(I) 40 | [η] 1.72 m.p. 202°C | " | 50 | 47 | " |
| Example 7 | PTMT 60/(J) 40 | [η] 1.83 m.p. 200°C | " | 53 | 51 | " |

Note:
PET Polyethylene terephthalate
PTMT Polytetramethylene terephthalate
M-PTMT: Polytetramethylene terephthalate containing 5% by mole of a diethylamino-S-triazine unit
(A): Polytetramethyleneether glycol having a molecular weight of approximately 1,000
(D): Polytetramethyleneether glycol having a molecular weight of approximately 380
(E): Hydrogenated polybutadiene glycol having a molecular weight of approximately 1,000
(F): Poly(ethylene-propylene)ether glycol having a molecular weight of approximately 2,000 (copolymer of 40% by mole of ethylene oxide and 60% by mole of propylene oxide)
(G): Polytetramethyleneether glycol having a molecular weight of approximately 1,000
(H): Polytetramethyleneether glycol having a molecular weight of approximately 4,000
(I): Polyethyleneether glycol having a molecular weight of approximately 1,500
(J): Polypropylene glycol having a molecular weight of approximately 1,500

EXAMPLE 8

Polytetramethylene terephthalate containing 10% by mole of a tetramethylene isophthalate unit and having an intrinsic viscosity [η] of 1.0 and the same block copolymer as that used in Example 1 were spun by a melt spinning procedure at a ratio of 1 : 1 by weight into side-by-side composite filaments having a fineness of 245 denier/24 fils. The undrawn composite filaments were drawn 3.50 times their original length at room temperature, by using a porcelain pin of a 10 mm diameter, and wound up on a pirn. Withdrawal of the undrawn filaments from the bobbin and the operation of drawing and winding could be smoothly performed without such troubles as fluffing of the filaments or the undesirable winding of the filaments on a roller. The crimped filaments which were obtained by unwinding the drawn filaments from the pirn had a percentage crimp of 58% and a percentage crimp retentivity of 63% and were excellent in stretchability and bulkiness.

The crimped filaments, after being knitted into hosiery, were dyed in the same manner as those in Example 1. The resultant hosiery had a soft feel and was excellent in elastic properties. The dye receptivity was approximately 3.5 times that observed when a commercially available polyethylene terephthalate textured filament was dyed.

EXAMPLE 9

The undrawn composite filaments obtained in the same manner as those in Example 1 were drawn 3.25 times their original length by using a chromium plated pin of a 32 mm diameter and heated at a temperture of 60°C. The drawing could be smoothly performed. The drawing filaments were continuously fed at an overfeed rate of 45% through an ejector into a box heated to a temperature of 150°C to effect the heat-setting and the development of crimps. The crimped filaments had very fine, uniform crimps. The percentage crimp and the percentage crimp retentivity were 55% and 70%, respectively.

EXAMPLE 10

The polycondensation of Example 1 was repeated wherein the ratio of dimethyl terephthalate : 1,4-butanediol : polytetramethyleneether glycol was varied to 100 : 74 : 76, to prepare a block copolymer consisting of 60% by weight of polytetramethylene terephthalate component and 40% by weight of polytetramethyleneether glycol component and having an intrinsic viscosity [$\eta$] of 1.63.

This block copolymer having 1% by weight, based on the copolymer, of a nickel compound of the formula:

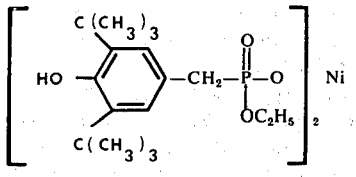

incorporated therein, as a first component, and polytetramethylene terephthalate having an intrinsic viscosity of 0.95, as a second component, the weight ratio of the first and second components being 1 : 1, were spun at a temperature of 250°C, into side-by-side composite filaments having a fineness of 160 denier/5 fils. The filaments were then drawn 3.56 times their original length by means of a chromium plated pin having a diameter of 30 mm, maintained at a temperature of 60°C, and wound up on a pirn. The product had a percentage crimp of 59% and a percentage crimp retentivity of 61%. Light resistance of the product was tested. In the test, a filament specimen fixed on a paper frame at a relaxation of 3% was exposed to a carbon arc for 50 hours at a temperature of 65°C in a Fade Ometer (supplied by Toyo Rika Kogyo Co., Ltd.). Tenacities of the sample before ($S_o$) and after (S) the exposure were determined, and a percent of tenacity retentivity was calculated in accordance with the following equation:

$$\% \text{ tenacity retentivity} = (S/S_o) \times 100$$

The product of this Example had a percent tenacity retentivity of 75%, whereas a comparable sample containing no stabilizer that of 50%.

EXAMPLE 11

The polymerization of Example 1 was repeated except that the ratio of dimethyl terephthalate : 1,4-butanediol : polytetramethyleneether glycol was varied to 100 : 74 : 20. A block copolymer was obtained consisting of 85% by weight of polytetramethylene terephthalate and 15% by weight of polytetramethyleneether glycol and having an intrinsic viscosity [$\eta$] of 1.23.

This block copolymer and a block copolymer prepared in a manner as described in Example 10, the weight ratio of these block copolymers being 1 : 1, were spun at a temperature of 250°C into side-by-side composite filaments of 160 denier/5 fils. The filaments were then drawn at an ambient temperature 3.7 times their original length by means of a ceramic pin, and wound up on a pirn. The drawn product had a percentage crimp of 72% and a percentage crimp retentivity of 67%.

A hosiery knitted from the product of this Example was highly stretchable and had a soft feel.

EXAMPLE 12

The procedure of Example 10 was repeated except that the spun composite filaments were drawn by means of a ceramic pin of 10 mm in diameter in two stages, at draw ratios of 3.1 and 1.15 in the first and second drawing stages. During the drawing in both stages, no fluffing or breakage of filaments was observed and the drawn filaments could be stably wound up on a pirn. The product had a percentage crimp of 65% and a percentage crimp retentivity of 67%.

What we claim is:

1. A unitary spun composite filament consisting essentially of (*a*) a block copolymer, as the first component, having a melting point of not lower than 170°C and consisting essentially of 35 to 80% by weight of a polyester, as the hard segment, containing not less than 80% by mole of a tetramethylene terephthalate unit and 20 to 65% by weight of units derived from polytetramethyleneether glycol having a molecular weight of 500 to 5000 and (*b*) a polyester, as the second component, containing not less than 80% by mole of a tetramethylene terephthalate unit, said components (*a*) and (*b*) being present in the filament in a side-by-side relationship and bonded together.

2. A unitary spun composite filament according to claim 1, wherein said polyester as the hard segment consists essentially of not less than 80% by mole of a tetramethylene terephthalate unit and not more than 20% by mole of a condensate unit of terephthalic acid with at least one alcohol selected from ethylene glycol, trimethylene glycol, 1,4-cyclohexane-dimethanol, glycerin and pentaerythritol.

3. A unitary spun composite filament according to claim 1, wherein said polyester as the hard segment consists essentially of not less than 80% by mole of a tetramethylene terephthalate unit and not more than 20% by mole of a condensate unit between at least one alcohol selected from ethylene glycol, trimethylene glycol, tetramethylene glycol, 1,4-cyclohexanedimethanol, glycerin and pentaerythritol and at least one dicarboxylic acid selected from isophthalic acid, 1,4- or 1,5-naphthalene dicarboxylic acid, adipic acid and sebacic acid.

4. A unitary spun composite filament according to claim 1, wherein said block copolymer as the first component contains 0.05 – 15% by weight, based on the copolymer, of copolymerized unit derived from at least one compound selected from the compounds of the formula:

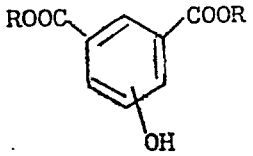

wherein R is a member selected from hydrogen atom, alkyl group having 1 through 8 carbon atoms and phenyl group, and OH group is attached to o- or m-position to COOR group; and the compounds of the formula:

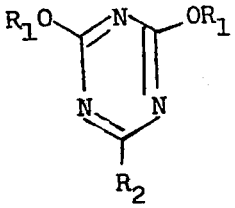

wherein $R_1$ is a member selected from alkyl groups having 1 through 7 carbon atoms and phenyl group, and $R_2$ is an alkyl- or dialkyl-amino group having 1 through 12 carbon atoms.

5. A unitary spun composite filament according to claim 1, wherein said block copolymer as the first component contains 0.01 – 7% by weight, based on the copolymer of at least one compound incorporated therein selected from sym-di-$\beta$-naphthyl-p-phenylenediamine and the compounds of the formula:

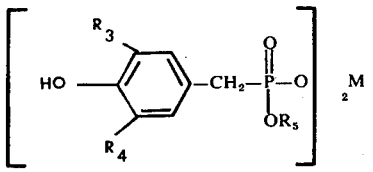

wherein $R_3$ and $R_4$ are the same or different and represent a hydrogen atom or a hydrocarbon radical having 1 through 10 carbon atoms, $R_5$ represents a hydrocarbon radical having 1 through 10 carbon atoms and M represents Ni or Mn.

6. A unitary spun composite filament according to claim 1, wherein said block copolymer as the first component, has a melting point of not lower than 190°C and consists essentially of 45 to 80% by weight of a polyester, as the hard segment, containing not less than 80% by mole of a tetramethylene terephthalate unit and 20 to 55% by weight of units derived from polytetramethyleneether glycol having a molecular weight of 500 to 5000.

7. A unitary spun composite filament according to claim 1, wherein said polyester as the second component consists essentially of not less than 80% by mole of a tetramethylene terephthalate unit and not more than 20% by mole of a condensate unit of terephthalic acid with at least one alcohol selected from ethylene glycol, trimethylene glycol, 1,4-cyclohexanedimethanol, glycerin and pentaerythritol.

8. A unitary spun composite filament according to claim 1, wherein said polyester as the second component consists essentially of not less than 80% by mole of a tetramethylene terephthalate unit and not more than 20% by mole of a condensate unit between at least one alcohol selected from ethylene glycol, trimethylene glycol, tetramethylene glycol, 1,4-cyclohexanedimethanol, glycerin and pentaerythritol and at least one dicarboxylic acid selected from isophthalic acid, 1,4- or 1,5-naphthalene dicarboxylic acid, adipic acid and sebacic acid.

9. A unitary spun composite filament according to claim 1, wherein said polyester as the second component consists essentially of not less than 80% by mole of a tetramethylene terephthalate unit and not more than 20% by mole of a condensate unit between at least one glycol selected from polyethyleneether glycol, polypropyleneether glycol, poly-tetramethyleneether glycol, a copolymer of ethylene oxide and propylene oxide, polybutadiene glycol, polyisoprene glycol and hydrogenated products of polybutadiene and poly-isoprene glycols and at least one dicarboxylic acid selected from terephthalic acid, isophthalic acid, 1,4- or 1,5-naphthalene dicarboxylic acid, adipic acid and sebacic acid.

10. A unitary spun composite filament according to claim 1, wherein said first component has an intrinsic viscosity [$\eta$] of at least 1.3 and said second component has an intrinsic viscosity [$\eta$] of at least 0.6.

* * * * *